US005799752A

United States Patent [19]

Perry

[11] Patent Number: 5,799,752

[45] Date of Patent: Sep. 1, 1998

[54] CLIMBING DEVICE

[76] Inventor: Ronald Perry, 8115 Atlantic St., Masury, Ohio 44438

[21] Appl. No.: 526,667

[22] Filed: Sep. 11, 1995

[51] Int. Cl.[6] ..... F06C 1/36

[52] U.S. Cl. ..... 182/206; 182/196

[58] Field of Search ..... 182/206, 196, 182/197, 198; 248/297.51

[56] References Cited

U.S. PATENT DOCUMENTS

| | | | |
|---|---|---|---|
| 3,336,999 | 8/1967 | McSwain | 182/206 |
| 3,961,686 | 6/1976 | Starkey | 182/196 |
| 3,995,714 | 12/1976 | Brookes et al. | 182/206 |
| 4,009,763 | 3/1977 | Hunter | 182/187 |
| 4,098,372 | 7/1978 | Luckey | 102/196 |
| 4,113,055 | 9/1978 | Gleockler et al. | 182/63 |
| 4,129,198 | 12/1978 | Hunter | 182/187 |
| 4,469,195 | 9/1984 | Sartain | 182/206 |
| 4,545,460 | 10/1985 | Byrd | 182/107 |
| 4,844,207 | 7/1989 | Andrews et al. | 182/151 |
| 5,332,063 | 7/1994 | Amacker | 182/116 |

*Primary Examiner*—Alvin C. Chin-Shue
*Assistant Examiner*—Anita M. King
*Attorney, Agent, or Firm*—Harpman & Harpman

[57] ABSTRACT

A climbing device for clamping around a tree trunk having a generally C-shaped clamp configuration including oppositely disposed trunk engagement portions; a handle portion extending vertically therefrom for positioning the device on the tree trunk; a flexible ladder secured to a horizontal offset aperture support leg extends from the trunk engagement portion. The ladder is capable of being used when the climbing device is engaged about the tree.

10 Claims, 4 Drawing Sheets

PRIOR ART

CLIMBING DEVICE

BACKGROUND OF THE INVENTION

1. Field of the Invention

The present invention relates to a climbing device and the like that are used to assist a person in climbing a tree by providing a support for a ladder.

2. Description of the Prior Art

The use of pole and tree ladders is known in the prior art. More specifically, pole and tree ladders heretofore devised and utilized for the purpose of supporting a user as they climbed a tree or pole are known to consist of a variety of devices.

By way of example U.S. Pat. No. 4,009,763 to Hunter disclosed a pole ladder. U.S. Pat. No. 4,113,055 to Gleockler and Gloeckler to discloses a tree ladder. U.S. Pat. No. 4,129,198 to Hunter discloses a pole seat and ladder. U.S. Pat. No. 4,545,460 to Byrd discloses a ladder fastening device for pole climbing. U.S. Pat. No. 4,844,207 to Andrews and Andrews discloses a tree ladder. Lastly, U.S. Pat. No. 5,332,063 to Amacker discloses a ladder stand.

In this respect, the climbing device according to the present invention substantially departs from the conventional concepts and designs of the prior art, and in doing so provides an apparatus primarily developed for the purpose of assisting a person in climbing a tree when the clamp end of the device is placed around a tree trunk at a height above the climber's head and the ladder end is allowed to hang freely against the tree trunk, and further providing an easy to use light weight climbing device or dear drag for use by a hunter that is compact for easy storage when not in use.

SUMMARY OF THE INVENTION

A climbing device for climbing trees by providing a C-shaped clamp that is engageable around three sides of a tree trunk, gripping the tree by engaging between oppositely disposed portions under offsetting vertical force imparted to the clamp by an attached depending flexible ladder.

OBJECTS OF THE INVENTION

It is therefore an object of the present invention to provide a new and improved climbing device which has all of the advantages of the prior art pole and tree ladders and none of the disadvantages.

It is another object of the present invention to provide a new and improved climbing device which may be easily and efficiently manufactured and marketed, and is of durable and solid construction.

An even further object of the present invention is to provide a new and improved climbing device which is susceptible of a low cost of manufacture with regard to both materials and labor, and which accordingly is then susceptible of low prices of sale to the consuming public, thereby making such climbing device economically available to the buying public.

Even still another object of the present invention is to provide a new and improved climbing device for assisting a person in climbing a tree when the clamp end of the device is placed around a tree trunk at a height above the climber's head and the ladder end is allowed to hang freely against the tree trunk, and further providing an easy to use light weight climbing device or dear drag for use by a hunter that is compact for easy storage when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The same reference numerals refer to the same parts through the various Figures.

DESCRIPTION OF THE PREFERRED EMBODIMENT

Figure 1:
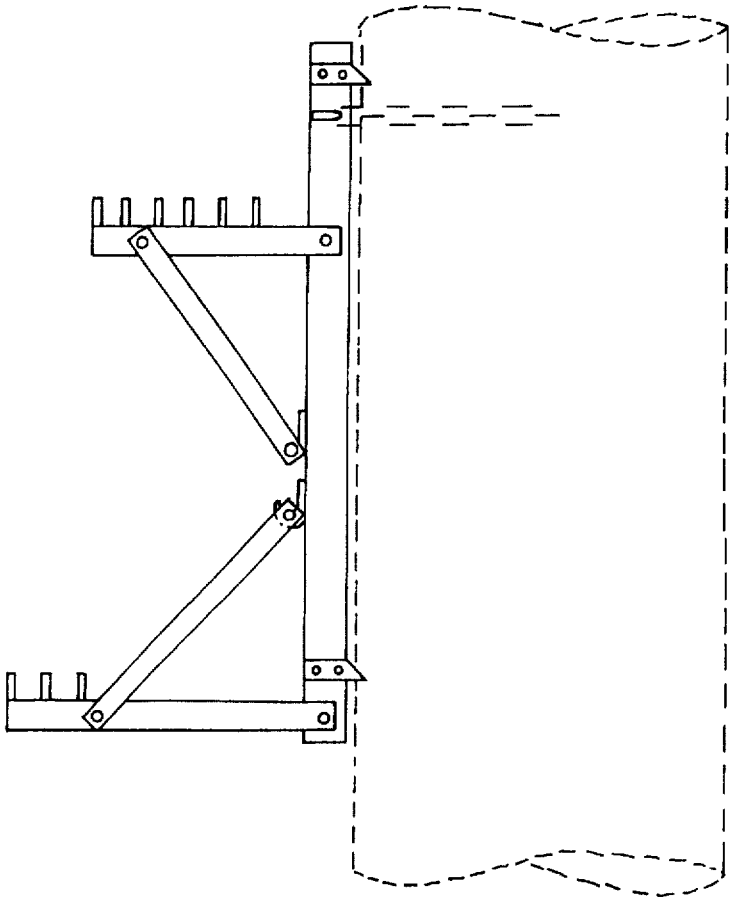
FIG. 1 is a perspective view of the preferred embodiment of the prior art pole ladder.
Figure 2:
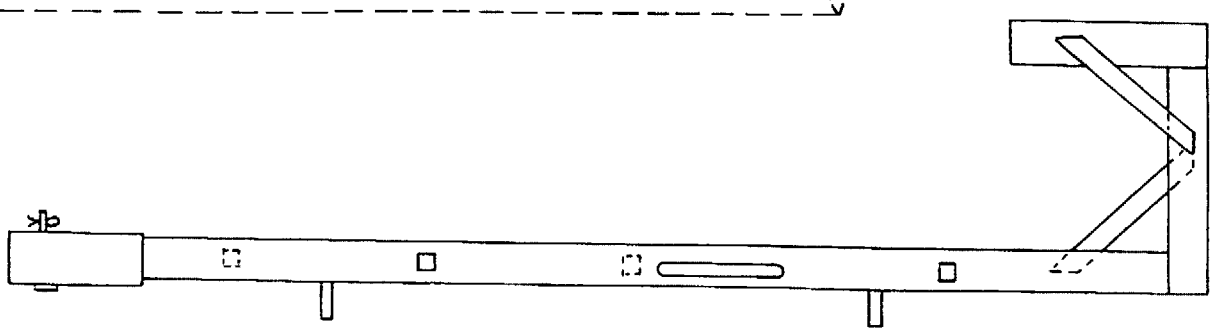
PRIOR ART Fig. 2
FIG. 2 is a perspective view of the preferred embodiment of the prior art tree ladder.

Referring to FIG. 1 of the drawings, the Climbing device 10 is comprised of a clamp, a pair of eyebolts, a support eyebolt, and a ladder.

Figure 3:
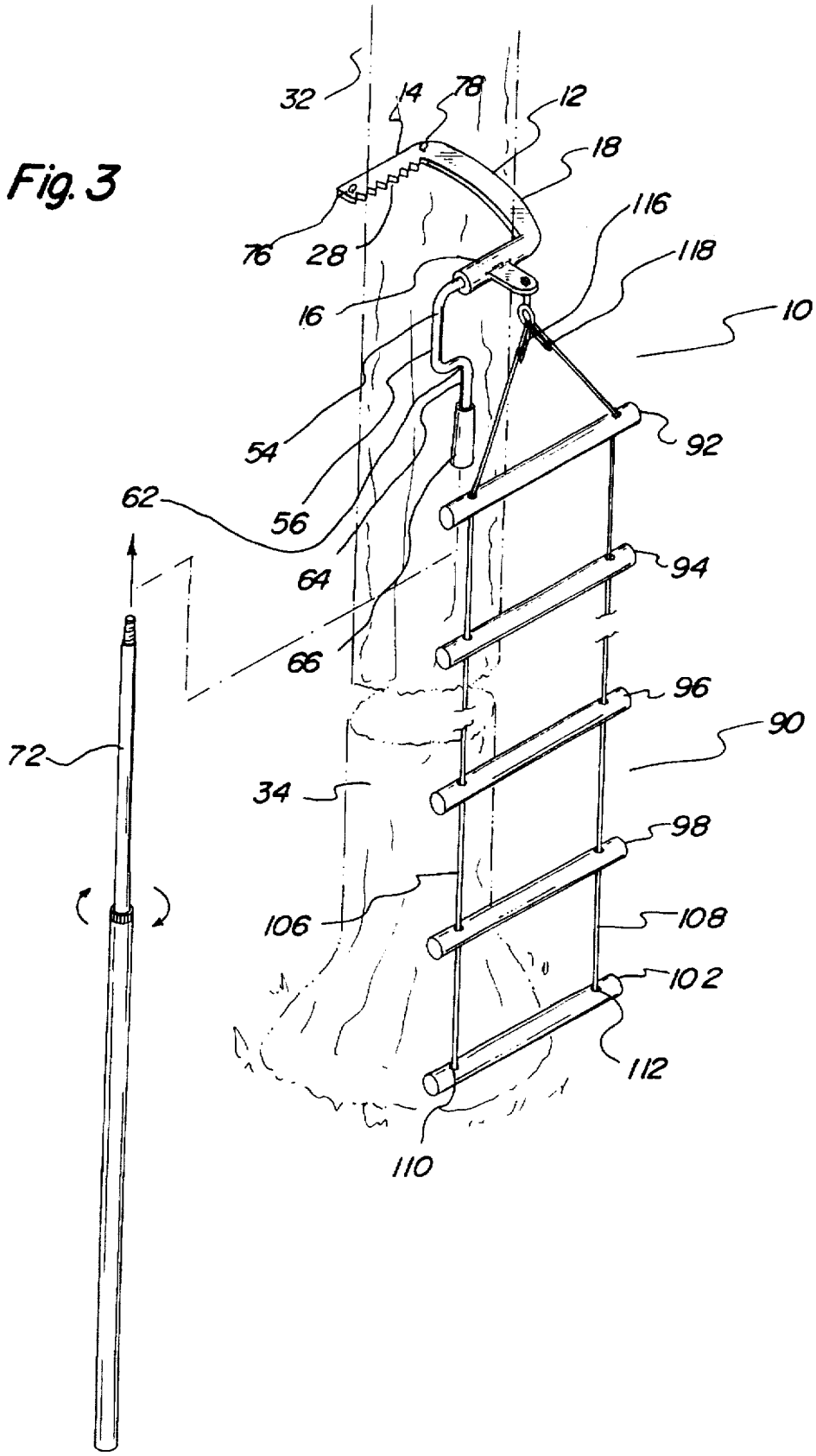
FIG. 3 is a perspective view of the preferred embodiment constructed in accordance with the principles of the present invention.
Figure 4:
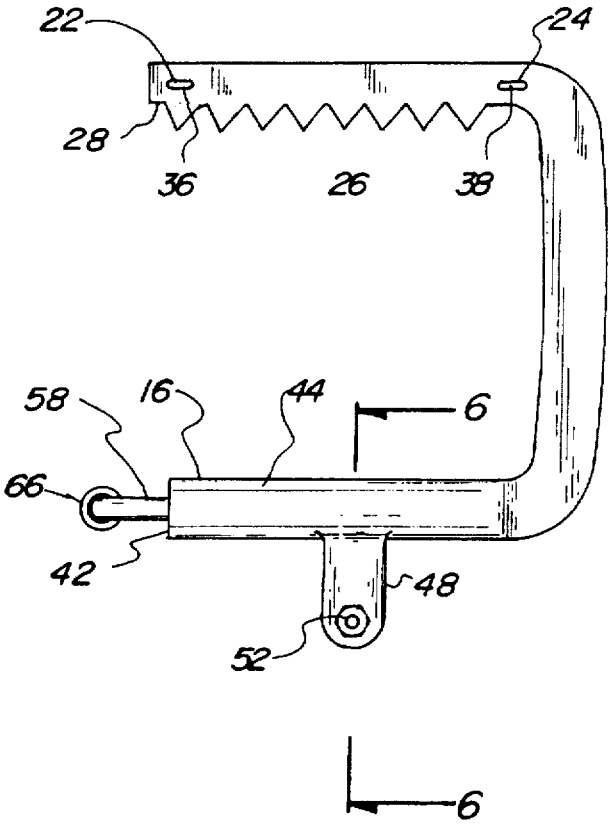
FIG. 4 is a top plan view of the present invention.

Specifically the present invention includes a C-shaped clamp 12 of rigid material having a cylindrical cavity exterior portion 14, a cylindrical interior portion 16 and a convex portion therebetween 18 as shown in FIG. 3. The clamp is formed metals such as steel of aluminum. The shape of the clamp is to conform with the generally cylindrical shape of a tree trunk. The exterior portion has a first pair of holes 22 and 24 laterally spaced along a parallel axis therethrough. The exterior portion further has a rigid member 26 with angular projections 28 contained therein for clutching an exterior surface 32 of a tree trunk 34. The rigid member is formed of a metal or metal alloy. The angular projections will not penetrate the tree trunk completely. The rigid member has a second pair of holes 36 and 38 laterally spaced apart therethrough. Each hole of the rigid member aligned along a common vertical axis with each respective hole of the exterior portion. The cylindrical interior portion 16 has a front end 42 and an exterior side 44. The cylindrical interior portion has a U-shaped projection 48 extending from the exterior side. The projection is preformed onto the clamp. The projection has a support hole 52 centrally positioned therethrough. The interior portion further has interposed within a rigid rod 54 with a U-shaped upper portion 56 having a first end 58 positioned through the front end, as shown in FIG. 4, and a second end 62, as shown in FIG. 3, with a vertical extent 64 and a handle 66 extending downwardly therefrom. The handle is made of wood or a hard plastic. The handle is capable of engaging a pole handle attachment 72. The pole handle attachment engages the handle to allow a user to position the clamp around the tree trunk at a height above the head of the user.

Figure 5:
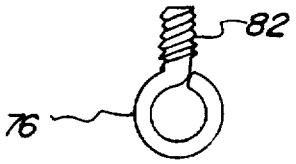
FIG. 5 is a side view of a small eyebolt of the present invention.

Also included is a pair of eyebolts 76 and 78 formed of rigid material such as metal or a metal alloy, as shown in FIG. 3. Each eyebolt has an external threaded portion 82 as depicted in FIG. 5. The pair of eyebolts are sized for rotational engagement of the first pair of holes 22 and 24 of the exterior portion 14 and the second pair of holes 36 and 38 of the rigid member along the common axis.

Figure 6:
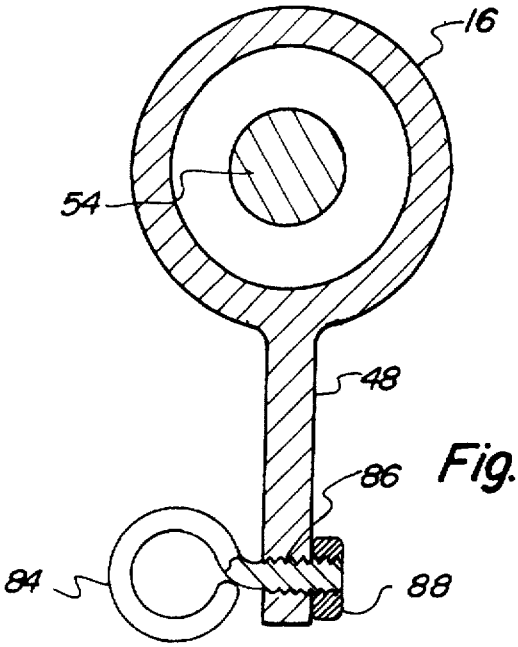
FIG. 6 is a sectional view along line 6—6 of FIG. 4 of the present invention.

A support eyebolt 84 formed of rigid material such as metal or a metal alloy is included. As best illustrated in FIG. 6, the support eyebolt has an external threaded portion 86. The support eyebolt is about two times the size of the pair of eyebolts 76 and 78 and sized for rotational engagement of the support hole 52 of the projection 48 of the interior portion 16. The support eyebolt is positioned in the support hole and secured therein with a nut 88.

Lastly, a ladder is included 90. The ladder is a vertical ladder formed of horizontal support members 92, 94, 96, 98, and 102 and a pair of flexible rope, members 106 and 108 as shown in FIG. 3. Each horizontal support member has a pair of receiving holes 110 and 112 laterally spaced therethrough along a parallel axis. Each hole has a diameter for slidable receipt of one of the pair of rope members. Each horizontal support member is parallel to another horizontal support member and spaced apart when each rope is parallel to the other rope is positioned through each receiving hole. Each rope has an end for coupling 116 and 118 the support eyebolt 84 and allowing the ladder to extend from the projection 48 of the interior portion of the clamp 12. The ladder is secured to the clamp positioned above the head of the user and supported by the support eyebolt 84 for the user to climb the ladder for positioning above the ground. The clamp grips the tree trunk when the user steps on the last horizontal support member and applies weight to the ladder.

Figure 7:
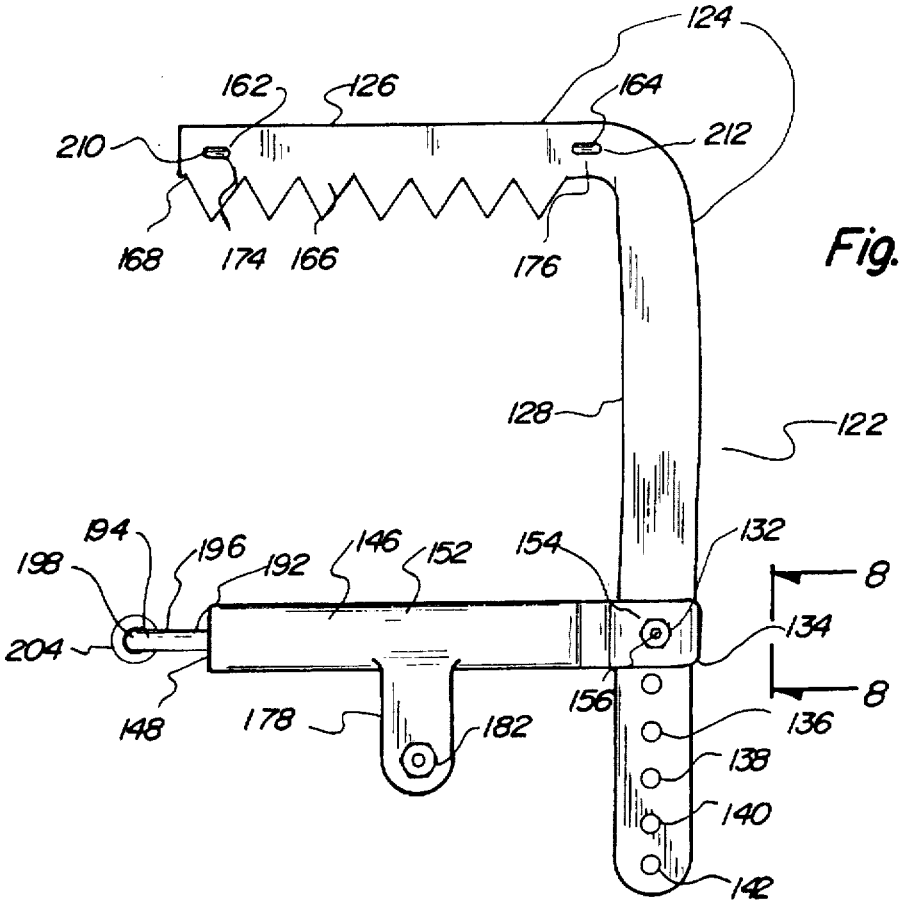
FIG. 7 is a top plan view of an alternative embodiment of the present invention.
Figure 8:
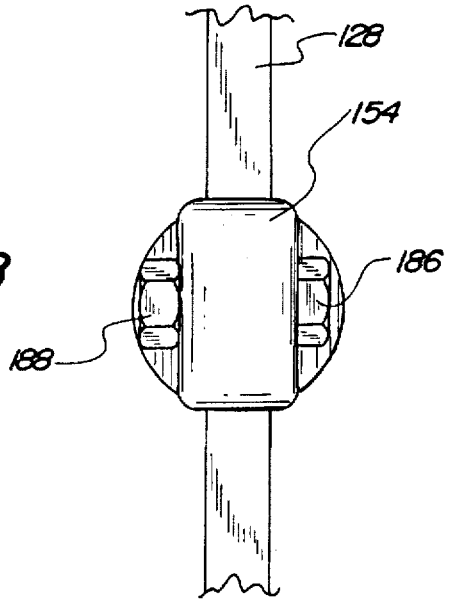
FIG. 8 is an enlarged side view along line 8—8 of FIG. 7.

FIG. 7 is an alternative embodiment of the climbing device for clamping around a tree trunk comprising, a clamp 122 of rigid material such as steel or aluminum. The clamp is formed of an L-shaped portion 124 with a cylindrical horizontal portion 126 and a vertical portion 128 extending therefrom having a plurality of holes 132, 134, 136, 138, 140 and 142 therein, and a cylindrical interior portion 146 with a front end 148, an exterior side 152 and a rear end 154 with an attachment hole 156 therethrough. The horizontal portion has a first pair of holes 162 and 164 laterally spaced along a parallel axis therethrough. The horizonal portion further having a rigid member 166 with angular projections 168 contained therein for clutching an exterior surface of a tree trunk. The rigid member has a second pair of holes 174 and 176 laterally spaced apart therethrough. Each hole of the rigid member is aligned along a common vertical axis with the respective hole of the horizontal portion. The cylindrical interior portion has a U-shaped projection 178 extending from the exterior side and symmetrical the front end and the rear end. The projection has a support hole 182 centrally positioned therethrough. The attachment hole is capable of alignment with one of each hole of the vertical portion. As best illustrated in FIG. 8, the clamp has an inner area being adjustable when the interior portion is attached to the vertical portion by a hex bolt 186 being positioned through the attachment hole and one of each hole of the vertical portion. The hex bolt is coupled with a hex nut 188.

Also included is a rigid rod 192 formed of a metal or metal alloy as shown in FIG. 7. The rigid rod with a U-shaped upper portion 194 having a first end 196 interposed within the front end 148 of the interior portion 146 and a second end 198 with a vertical extent extending downwardly therefrom having a handle at an exterior end. The handle extending downwardly from the interior portion and capable of engaging a pole handle attachment 72. The pole handle attachment engages the handle when the rod 192 is interposed within the interior portion and allows a user to position the clamp 122 around the tree trunk at a height above the head of the user.

A pair of eyebolts 210 and 212 is provided as shown in FIG. 7. The pair of eyebolts formed of rigid material such as metal or metal alloy. Each eyebolt has an external threaded portion as shown in FIG. 5. The pair of eyebolts being sized for rotational engagement of the first pair of holes 162 and 164 of the exterior portion and the second pair of holes 174 and 176 of the rigid member 166 along the common axis. Each eyebolt securing the rigid member within the exterior portion of the clamp and preventing the clamp 122 from sliding off the rigid member when the clamp being position around the tree trunk.

Further included is a support eyebolt 214 formed of rigid material such as metal or metal alloy. The support eyebolt has an external threaded portion 216 and is about two times the size of the pair of eyebolts. The support eyebolt is sized for rotational engagement of the support hole 182 of the projection 178 of the interior portion 146. The support eyebolt is positioned in the support hole and secured therein with a nut 218. As to the manner of usage and operation of the present invention, the same should be apparent from the above description. Accordingly, no further discussion relating to the manner of usage and operation will be provided.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A new and improved Climbing device comprising, in combination:

a C-shaped clamp of rigid material having a cylindrical cavity exterior portion, a cylindrical interior portion and a convex portion therebetween, the exterior portion having a rigid member with angular projections contained therein for clutching an exterior surface of a tree trunk, the cylindrical interior portion having a front end and an exterior side, the cylindrical interior portion having projection extending from the exterior side, the projection having a support hole centrally positioned therethrough, the interior portion further having interposed within a rigid rod with a U-shaped upper portion having a first end positioned through the front end and a second end with a vertical extent, the vertical extent having a handle extending downwardly therefrom, the pole handle attachment engaging the handle for allowing a user to position the clamp around the tree trunk at a height above the head of the user;

a vertical ladder formed of a multiplicity of rigid cylindrical horizontal support members and a pair of flexible rope members, means for securing said ladder to said clamp.

2. A climbing device for clamping around a tree trunk comprising;

a clamp having a cavity exterior portion with a first pair of holes therethrough, an interior portion with a front end and an exterior side and a convex portion therebetween, the exterior portion further having a rigid member contained therein, the rigid member having a second pair of holes therethrough aligned along a common vertical axis with each first pair of holes, the exterior side having a projection with a support hole therethrough, the interior portion having a rigid rod interposed within at the front end with a vertical extent for allowing a user to position the clamp around a tree trunk at a height above the head of the user;

a pair of eyebolts for engaging the first pair of holes of the exterior portion and the second pair of holes of the rigid member;

a support eyebolt for engaging the support hole of the projection of the interior portion; and a ladder formed of a multiplicity of horizontal support members having a pair of receiving holes and a pair of rope members capable of being secured to the support eyebolt, the ladder capable of being used when the clamp is positioned around the tree.

3. The climbing device as set forth in claim 2 wherein the clamp is formed of a rigid material having a C-shaped configuration.

4. The climbing device as set forth in claim 2 wherein the cavity exterior portion is cylindrical and the first pair of holes therethrough are laterally spaces along a parallel axis.

5. The climbing device as set forth in claim 2 wherein the rigid member has angular projections for clutching an exterior surface of a tree trunk.

6. The climbing device as set forth in claim 2 wherein the second pair of holes are laterally spaced apart.

7. The climbing device as set forth in claim 2 wherein the rigid rod has a U-shaped upper portion with a first end positioned through the front end of the interior portion and a second end with the vertical extent extending downwardly therefrom.

8. The climbing device as set forth in claim 2 wherein the vertical extent has a handle capable of engaging a pole handle attachment for positioning the clamp around the tree trunk at a height beyond the reach of the user.

9. The climbing device as set forth in claim 2 wherein each eyebolt is formed of a rigid material and has an external threaded portion for rotatable engagement of the first pair of holes and the second pair of holes along the common axis.

10. The climbing device as set forth in claim 2 wherein each eyebolt further being capable of securing the rigid member within the exterior portion of the clamp and preventing the clamp from sliding off the rigid member when the clamp is positioned around the tree trunk.

* * * * *